US010867760B2

(12) United States Patent
Chen et al.

(10) Patent No.: US 10,867,760 B2
(45) Date of Patent: Dec. 15, 2020

(54) CONDUCTING SWITCH MECHANISM

(71) Applicant: HUA JIE (TAIWAN) CORPORATION, Taoyuan (TW)

(72) Inventors: Chieh Chen, Taipei (TW); Fa-Jui Wang, Taoyuan (TW); Yu-Chung Chang, New Taipei (TW)

(73) Assignee: HUA JIE (TAIWAN) CORPORATION, Taoyuan (TW)

( * ) Notice: Subject to any disclaimer, the term of this patent is extended or adjusted under 35 U.S.C. 154(b) by 0 days.

(21) Appl. No.: 16/684,592

(22) Filed: Nov. 15, 2019

(65) Prior Publication Data

US 2020/0161063 A1 May 21, 2020

(30) Foreign Application Priority Data

Nov. 16, 2018 (TW) ..... 107140798 A

(51) Int. Cl.

| | |
|---|---|
| ***H01H 13/14*** | (2006.01) |
| ***H01H 13/52*** | (2006.01) |
| ***H01H 13/10*** | (2006.01) |
| *H01H 13/06* | (2006.01) |

(52) U.S. Cl.

CPC ..... *H01H 13/52* (2013.01); *H01H 13/10* (2013.01); *H01H 13/14* (2013.01); *H01H 13/06* (2013.01); *H01H 2013/525* (2013.01)

(58) Field of Classification Search

CPC ..... H01H 13/14; H01H 13/20; H01H 3/42; H01H 9/041; H01H 13/063; H01H 13/183; H01H 13/64; H01H 15/02; H01H 15/06; H01H 1/242; H01H 13/12; H01H 13/28; H01H 13/48; H01H 13/10; H01H 13/06;

(Continued)

(56) References Cited

U.S. PATENT DOCUMENTS

| | | | | |
|---|---|---|---|---|
| 8,134,095 | B2 | 3/2012 | Kiyono et al. | |
| 2011/0147186 | A1* | 6/2011 | Mori | H01H 5/06 200/468 |

(Continued)

FOREIGN PATENT DOCUMENTS

| | | | |
|---|---|---|---|
| CN | 102144271 | B | 1/2014 |
| TW | 200737255 | A | 10/2007 |
| TW | 200737256 | A | 10/2007 |

*Primary Examiner* — Ahmed M Saeed

(74) *Attorney, Agent, or Firm* — Li & Cai Intellectual Property Office

(57) ABSTRACT

A conducting switch mechanism includes a housing, an operating stem is exposed from the housing, a fixed terminal set, a movable terminal module, a fulcrum bar, and an elastic member. The fixed terminal set is fixed on a base of the housing, and includes a pair of constant contact terminals, a pair of first pathway terminals, and a pair of second pathway terminals. The movable terminal module has a first movable terminal, a second movable terminal, and an insulating member. The insulating member partially clads the movable terminals. The structures of movable terminals are integrally stamped. One end of the movable terminals correspondingly abuts against the constant contact terminals, and another end of the movable terminals correspondingly contacts the first pathway terminal or the second pathway terminal. The elastic member is connected between the fulcrum bar and the movable terminal module.

9 Claims, 12 Drawing Sheets

(58) Field of Classification Search
CPC ..... H01H 2013/525; H01H 1/40; H01H 1/42;
H01H 13/30; H01H 1/56; H01H 9/0016
See application file for complete search history.

(56) References Cited

U.S. PATENT DOCUMENTS

| | | | | |
|---|---|---|---|---|
| 2017/0125189 | A1* | 5/2017 | Domzalski ..... | H01H 9/041 |
| 2017/0372851 | A1 | 12/2017 | Tsukanaka | |

* cited by examiner

CONDUCTING SWITCH MECHANISM

CROSS-REFERENCE TO RELATED PATENT APPLICATION

This application claims the benefit of priority to Taiwan Patent Application No. 107140798, filed on Nov. 16, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a conducting switch mechanism, and more particularly to a device for switching an electrical circuit between different conducting states. In a normal condition, no external force is applied on the device, and the device can provide a first conducting state. The device can provide a second conducting state when an external force is applied, and the device can automatically be reset to the first conducting state after the external force disappears.

BACKGROUND OF THE DISCLOSURE

A normal conducting switch mechanism can provide one conducting state when an external force is applied on a button of the normal conducting switch mechanism, and the normal conducting switch mechanism usually requires the external force be applied on the button again to reset the normal conducting switch mechanism to an original conducting state.

Some types of conducting switch mechanisms can automatically reset to the original conducting state after the external force disappears. Such types of conducting switch mechanisms are configured with a fixed terminal set and a movable terminal set. The movable terminal set can movably contact the fixed terminal set so as to switch the circuit between different conducting states. A spring is usually employed by the aforementioned kind of conducting switch mechanisms to provide the force to return the movable terminal set to its original position, so as to carry out an automatic reset function. However, during the sliding process of the movable terminal set, an error can easily be caused due to shaking, resulting in an inaccurate conduction. In addition, since the structure of the movable terminal set is complicated, the structure is usually required to be welded by a plurality of metal parts. Such method of manufacturing the movable terminal set is cumbersome and is prone to manufacturing errors.

SUMMARY OF THE DISCLOSURE

In response to the above-referenced technical inadequacies, the present disclosure provides a conducting switch mechanism that can maintain good contact precision and enhance the structural strength of the conducting switch mechanism.

In one aspect, the present disclosure provides a conducting switch mechanism including a housing, an operating stem, a fixed terminal set, a movable terminal module, a fulcrum bar, and an elastic member. The housing includes a cover and a base, in which an accommodating space is formed in the housing, a pair of holders is disposed on a top surface of the base, and two fulcrum bar connecting portions are correspondingly formed on each of the inner sides of each of the holders. A top end of the operating stem is exposed from the cover, and a bottom end of the operating stem extends into the accommodating space. The fixed terminal set is fixed on the base, and includes a pair of constant contact terminals, a pair of first pathway terminals and a pair of second pathway terminals. The movable terminal module includes a first movable terminal, a second movable terminal and an insulating member, in which the insulating member partially clads the first movable terminal and the second movable terminal, and both structures of the first movable terminal and the second movable terminal are formed by integral stamping. A first movable contact is formed on one end of the first movable terminal, and a first terminal pivot portion is formed on another end of the first movable terminal. A second movable contact is formed on one end of the second movable terminal, and a second terminal pivot portion is formed on another end of the second movable terminal. The first terminal pivot portion and the second terminal pivot portion are movably contacted with the constant contact terminals, and the first movable contact and the second movable contact are movably contacted with the pair of first pathway terminals or the pair of second pathway terminals. The fulcrum bar includes a force receiving portion and a base connecting portion, in which the force receiving portion can abut against the bottom end of the operating stem, and a front end of the base connecting portion is rotatably coupled with the fulcrum bar connecting portion of the base. One end of the elastic member is connected with a portion of the fulcrum bar and another end of the elastic member is connected with a portion of the movable terminal module.

Therefore, the conducting switch mechanism provided in the present disclosure has at least the following beneficial effects: both structures of the first movable terminal and the second movable terminal are formed by integral stamping so as to maintain good contact precision, avoid a cumulative tolerance from combining two individual parts of the movable terminals, and enhance the structural strength. The terminal pivot portions, the movable contacts and a body portion are all extended along the same plane, so that the terminal pivot portions, the movable contacts and the body portion are not required to be separately stamped and then welded. The terminal pivot portions of the first movable terminal and the second movable terminal, the movable contacts and the body portion are all extended along the same plane, so that the movable contacts can maintain a normal conduction with the fixed terminal set, and at the same time, the terminal pivot portions can abut against the pivot receiving portion to maintain sufficient elasticity.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
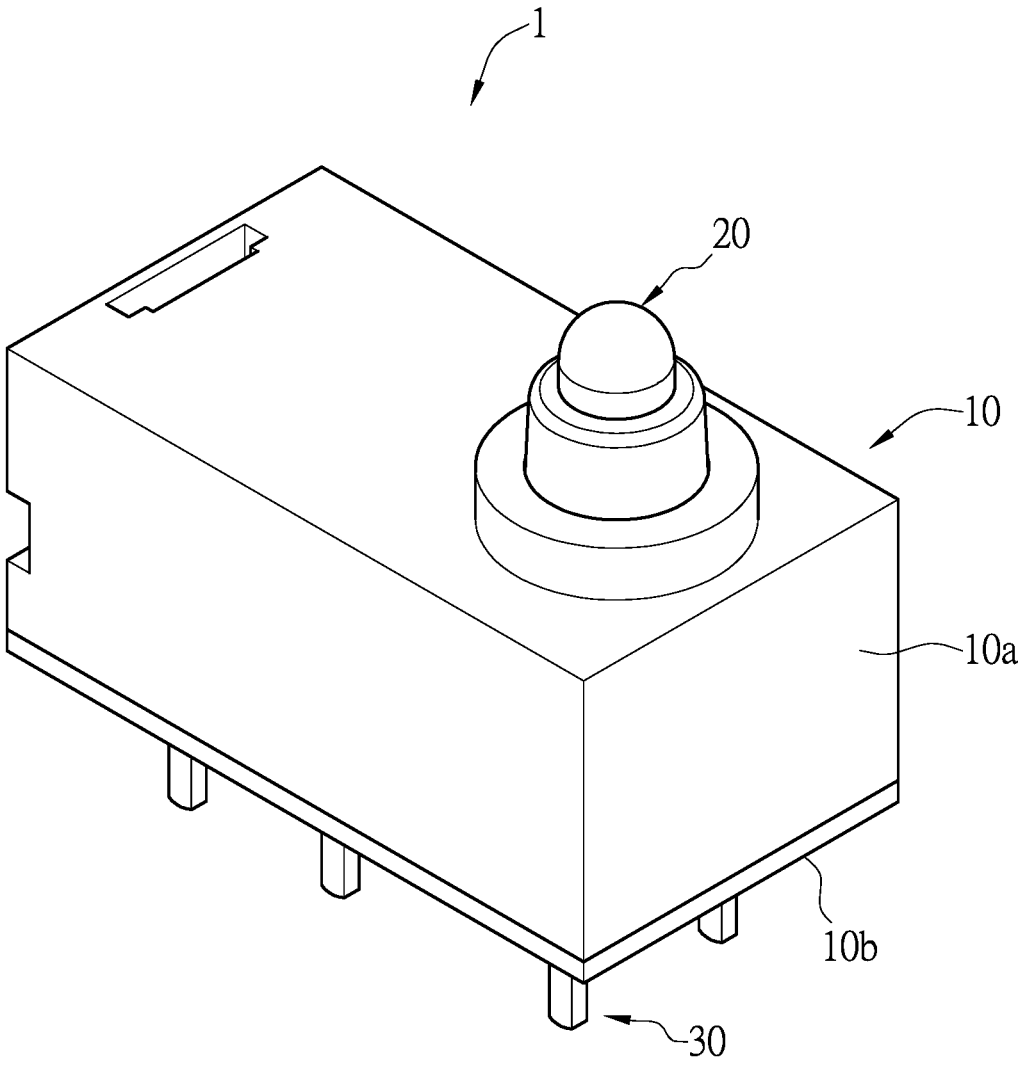
FIG. 1 is a perspective view of a conducting switch mechanism according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to the embodiment given herein. Numbering terms such as "first" or "second" can be used to describe various components, signals or the like, which are for distinguishing one component/signal from another one only, and are not intended to, nor should be construed to impose any substantive limitations on the components, signals or the like.

Figure 2:
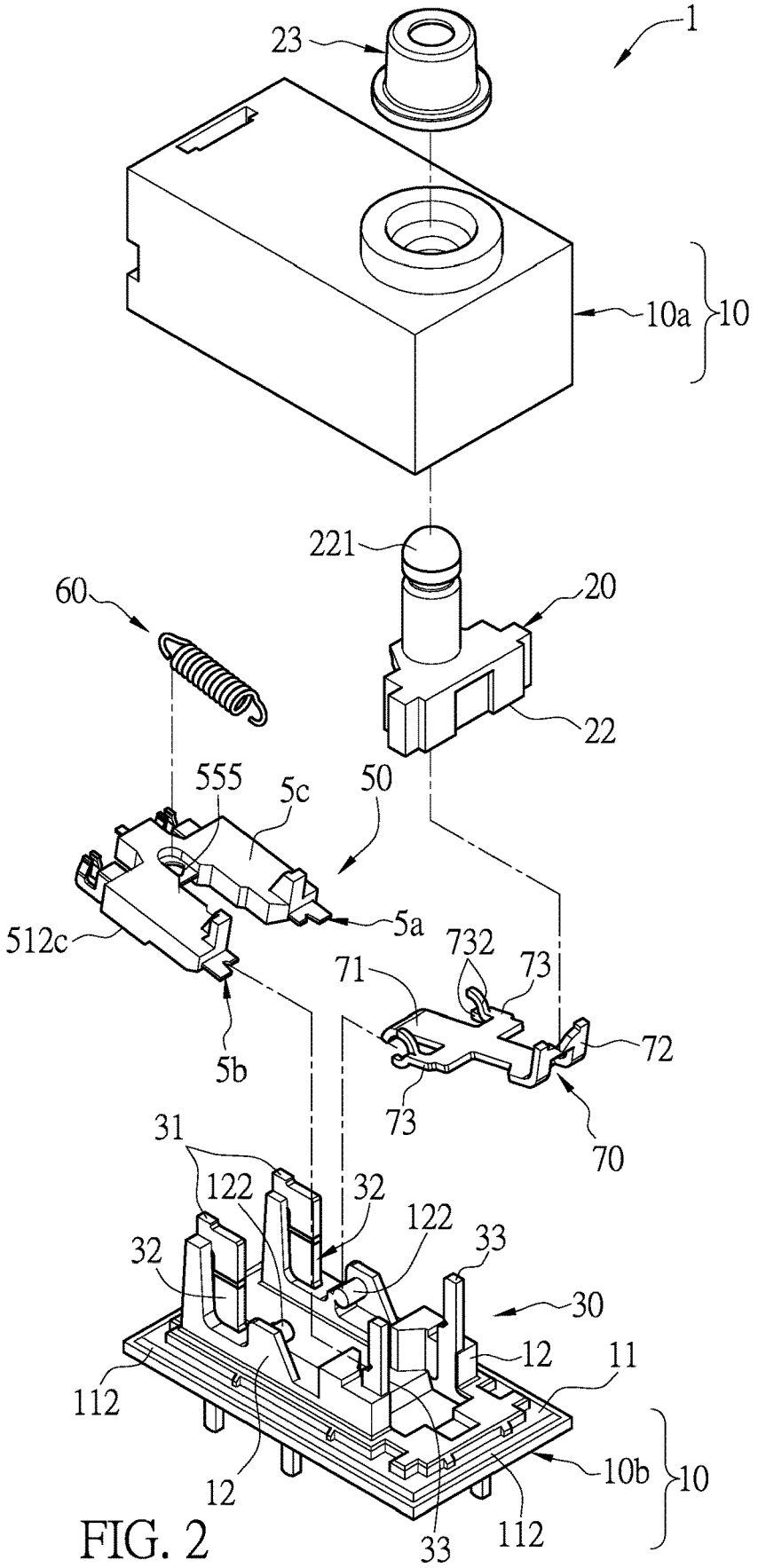
FIG. 2 is an exploded view of the conducting switch mechanism according to the present disclosure.
Figure 3:
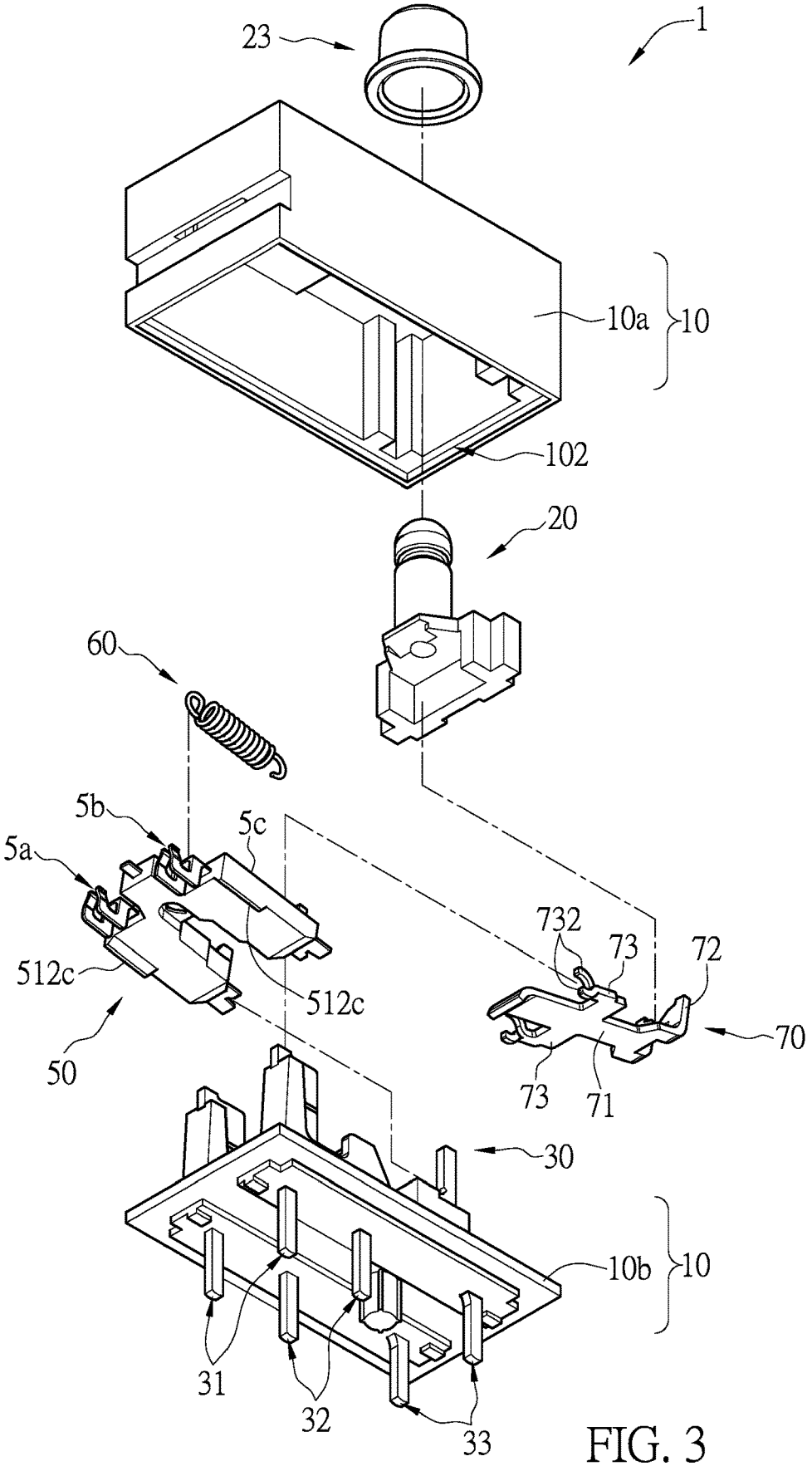
FIG. 3 is another exploded view of the conducting switch mechanism according to the present disclosure.

Referring to FIG. 1 to FIG. 3, FIG. 1 is a perspective view of a conducting switch mechanism 1 according to the present disclosure, FIG. 2 and FIG. 3 are exploded views of the conducting switch mechanism 1 according to the present disclosure. The present disclosure provides a conducting switch mechanism 1 including a housing 10, an operating stem 20, a fixed terminal set 30, a movable terminal module 50, an elastic member 60, and a fulcrum bar 70. Each component of the conducting switch mechanism 1 of the present disclosure will be described in detail later.

The housing 10 includes a cover 10*a* and a base 10*b*, the cover 10*a* and the base 10*b* cooperatively form an accommodating space. The cover 10*a* and the base 10*b* are made of an insulating material. The cover 10*a* and the base 10*b* of the present disclosure can be combined by processes, such as high frequency welding, laser welding or thermal welding, etc. Preferably, the cover 10*a* and the base 10*b* are combined to each other by high frequency welding, so as to improve the airtightness and waterproof performance of the housing. Referring to FIG. 2 and FIG. 3, in order to accomplish high frequency welding, a combination layer 11 is disposed on the base 10*b*, the area of the combination layer 11 is smaller than the area of a top surface of the base 10*b*, and a welding bevel 112 is formed on a peripheral edge of the combination layer 11. A chute 102 is formed on the bottom edge of the cover 10*a*, in which the chute 102 forms a slope, and the position and the shape of the chute 102 correspond to the welding bevel 112. By welding the welding bevel 112 and the slope, the present embodiment can have the advantages of easy alignment and large contact area. However, the present invention is not limited thereto.

The operating stem 20 passes through the top wall of the cover 10*a*, the top end of the operating stem 20 is exposed from the cover 10*a*, and a bottom end of the operating stem 20 extends into the accommodating space. In addition, a pushing portion 22 is disposed on a bottom of the operating stem 20, and a stem portion 221 is disposed on a top surface of the pushing portion 22. In the present embodiment, a cap 23 can be further disposed on the operating stem 20, and to be located on a top surface of the cover 10*a*. Preferably, the cap 23 is made of plastic so as to improve the airtightness around the operating stem 20, and can also provide a force to help the operating stem 20 return to the original position. In the present embodiment, the base 10*b* is substantially rectangular, and a longitudinal direction of the base 10*b* can be defined along the longer side of the rectangular. Referring to FIG. 2, a pair of holders 12 is disposed on the top surface of the base 10*b* to hold the fixed terminal set 30. The pair of holders 12 is oppositely located on both sides of the base 10*b*, and two fulcrum bar connecting portions 122 are correspondingly formed on each of the inner sides of each of the holders 12. In the present embodiment, the fulcrum bar connecting portion 122 of the base is in a round rod shape, and extends toward the inner side of the base 10*b* along a direction perpendicular to the longitudinal direction of the base 10*b*.

The fixed terminal set 30 is fixed on the base 10*b*. In the present embodiment, the fixed terminal set 30 includes a pair of constant contact terminals 33, a pair of first pathway terminals 31, and a pair of second pathway terminals 32. Referring to FIG. 3, each pair of terminals is arranged side by side in two columns; in other words, one first pathway terminal 31, one second pathway terminal 32 and one constant contact terminal 33 in each column are arranged in a line along the longitudinal direction of the base 10*b*.

Figure 4:
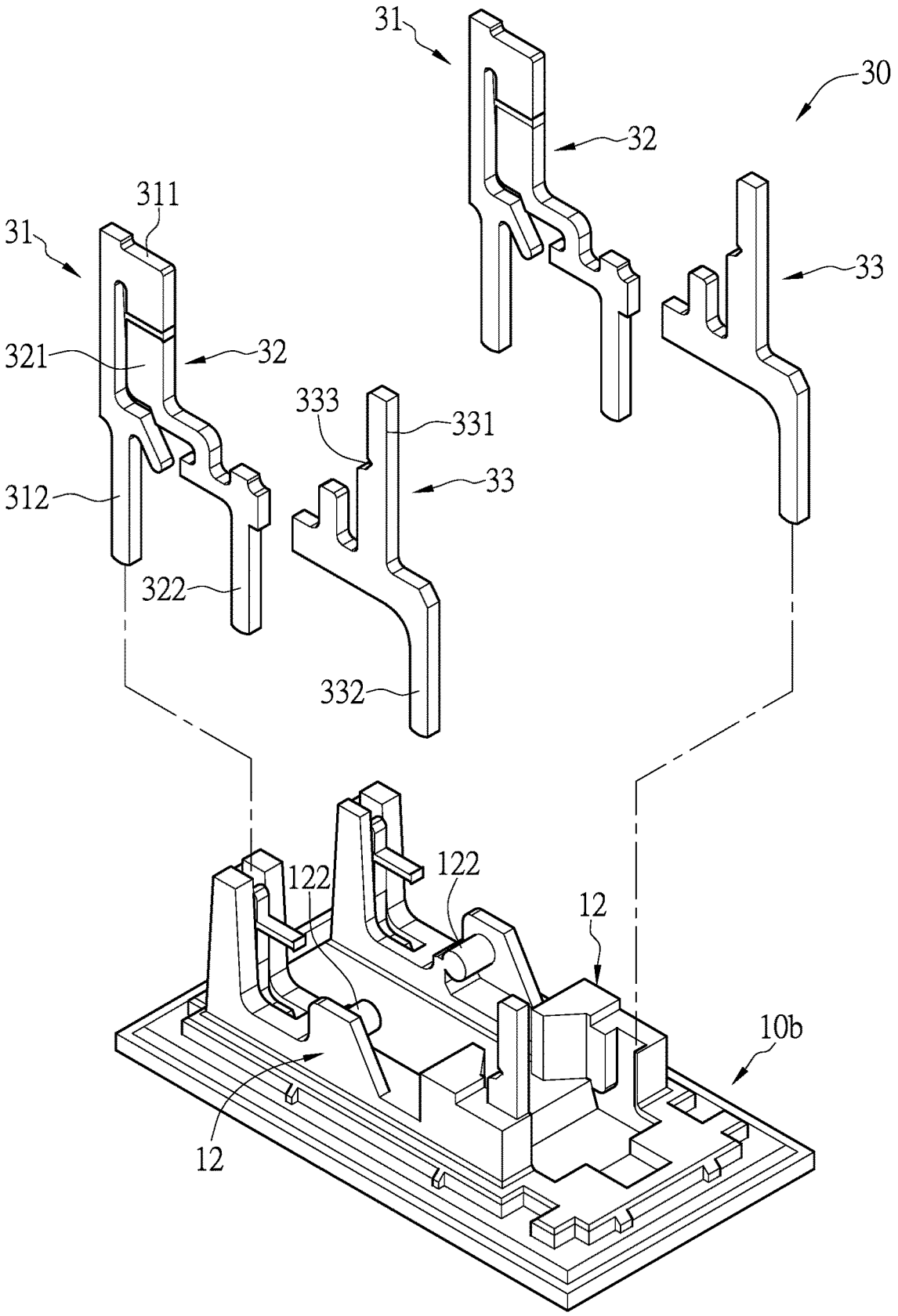
FIG. 4 is an exploded view of a fixed terminal set and a base according to the present disclosure.

Referring to FIG. 2 and FIG. 3 in conjunction with FIG. 4, FIG. 4 is an exploded view of a fixed terminal set and a base according to the present disclosure. The pair of first pathway terminals 31 is adjacent to the pair of second pathway terminals 32, and corresponds to the pair of constant contact terminals 33. Each of the first pathway terminals 31 includes a first sliding portion 311 and a first pin 312.

The first sliding portion 311 is exposed on the top surface of the base 10*b*. The first pin 312 extends downward from the first sliding portion 311 and is exposed on the bottom surface of the base 10*b*. The second pathway terminal 32 includes a second sliding portion 321 and a second pin 322. The second sliding portion 321 is exposed on the top surface of the base 10*b*. The second pin 322 extends downward from the second sliding portion 321 and is exposed on the bottom surface of the base 10*b*. The first sliding portion 311 is adjacent to the second sliding portion 321 and is arranged along a longitudinal direction parallel to the operating stem 20. As viewed from the angle of FIG. 4, the first sliding portion 311 is located above the second sliding portion 321. In the present embodiment, the first sliding portion 311 and the second sliding portion 321 are substantially square. The second pin 322 extends from the second sliding portion 321 away from the first pathway terminal 31, so as to be located between the first pathway terminal 31 and the constant contact terminal 33. Each of the constant contact terminals 33 includes a constant contact portion 331 and a constant pin 332. The constant contact portion 331 corresponds to the first sliding portion 311 and the second sliding portion 321, and the constant contact portions 331 are respectively located on both sides of the base 10*b*. The second pin 322 is located between the first pin and the constant pin. In the present embodiment, the constant pin 322 also extends from the constant contact portion 331 away from the first pathway terminal 31, so as to provide a wider insertion distance for the pins. In addition, a pivot receiving portion 333 is further formed on the constant contact portion 331, so that one end of the movable terminal module 50 can be movably supported at the pivot receiving portion 333.

Figure 5A:
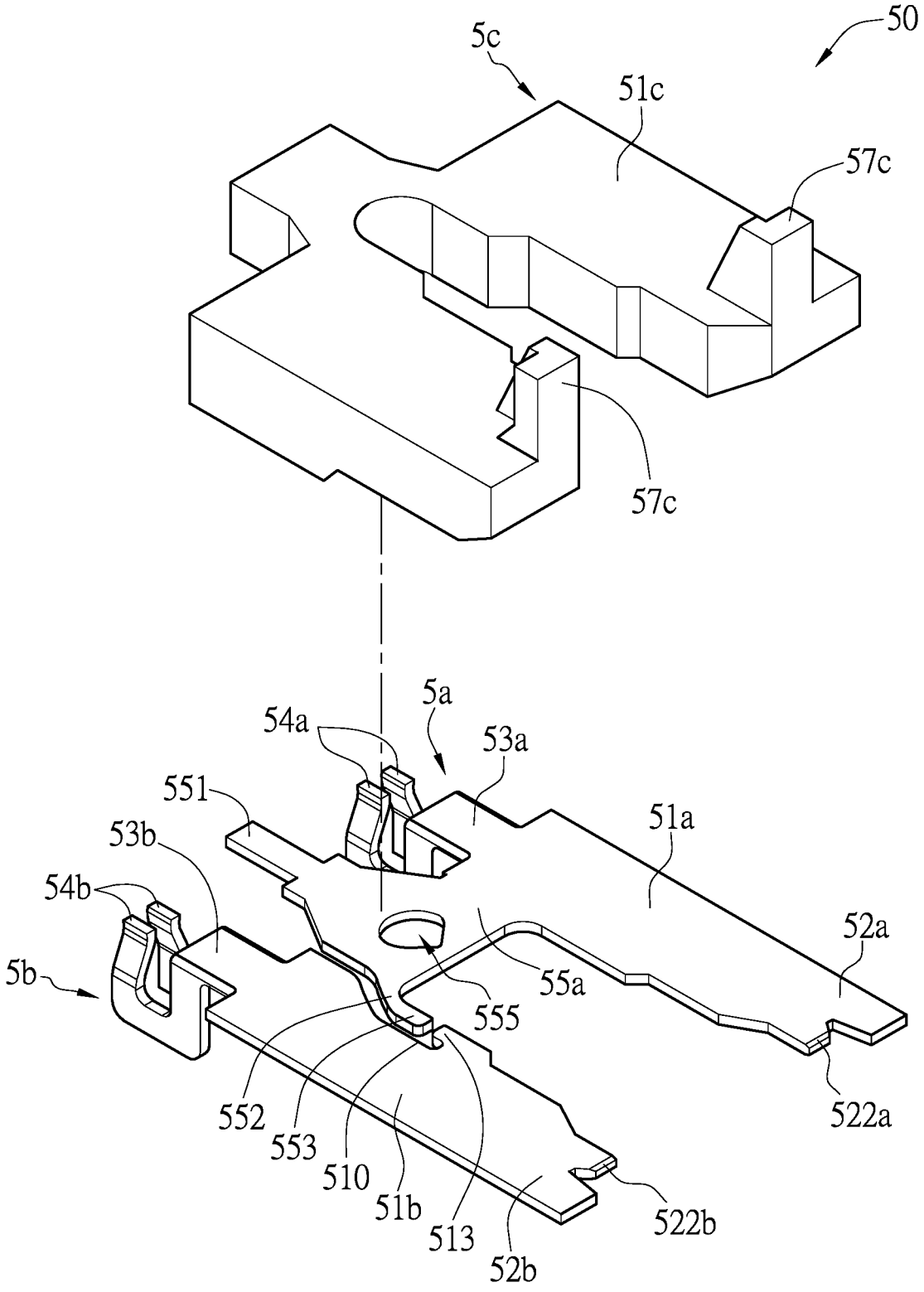
FIG. 5A is an exploded view of a movable terminal module according to the present disclosure.
Figure 5B:
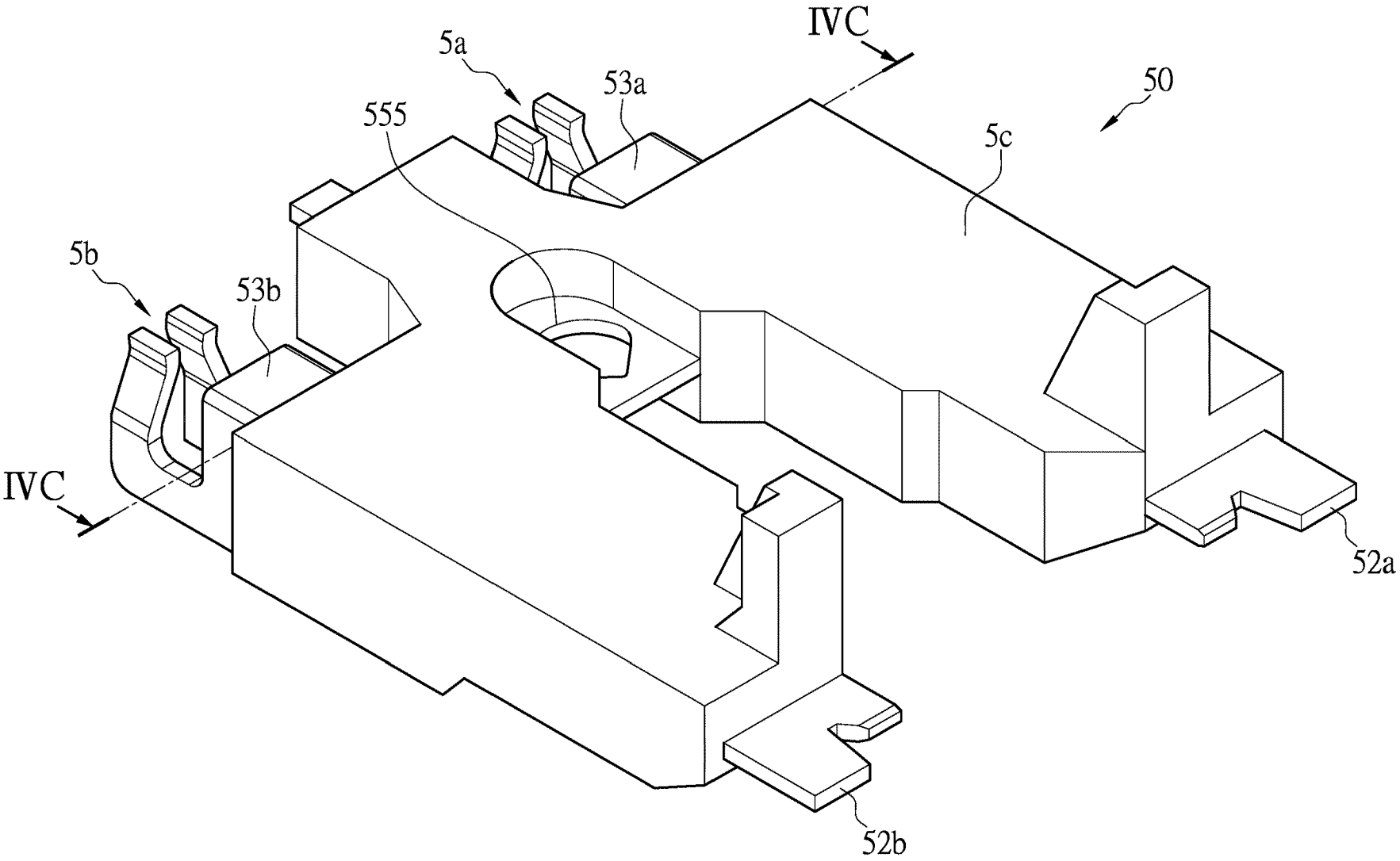
FIG. 5B is an assembled view of the movable terminal module according to the present disclosure.
Figure 5C:
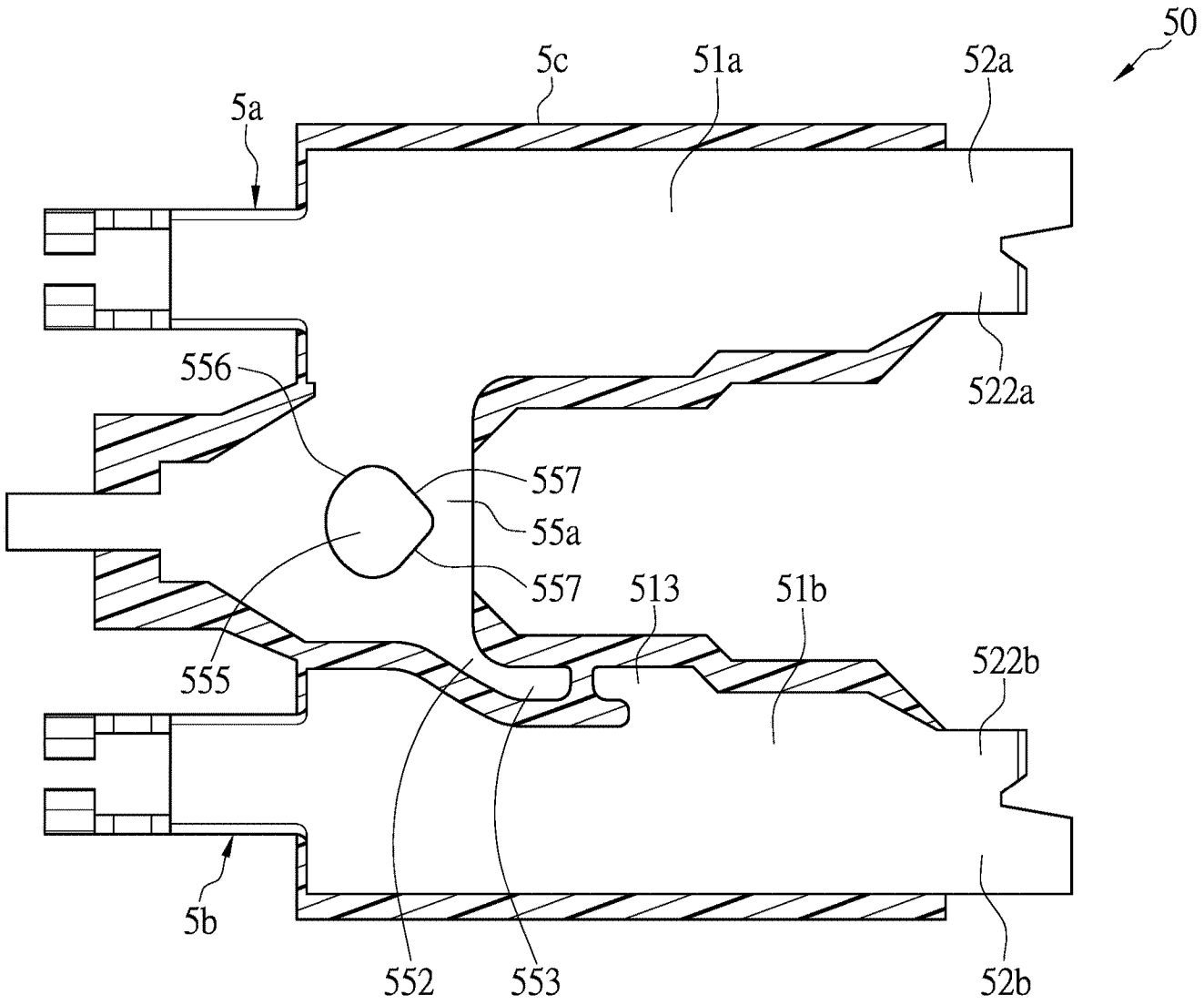
FIG. 5C is a sectional view of the movable terminal module according to the present disclosure.

Referring to FIG. 5A to FIG. 5C, the movable terminal module 50 includes a first movable terminal 5*a*, a second movable terminal 5*b* and an insulating member 5*c*. The insulating member 5*c* partially clads the first movable terminal 5*a* and the second movable terminal 5*b* as shown in FIG. 5B. Preferably, the movable terminal module 50 can be made by covering the first movable terminal 5*a* and the second movable terminal 5*b* with the insulating member 5*c* by insert injection molding. One of the features of the present embodiment is that both structures of the first movable terminal 5*a* and the second movable terminal 5*b* can be formed by integral stamping through just one stamping/bending procedure. The first movable terminal 5*a* includes a first movable contact 54*a* formed at one end thereof and a first terminal pivot portion 522*a* formed at the other end thereof.

The second movable terminal 5*b* includes a second movable contact 54*b* formed at one end thereof and a second terminal pivot portion 522*b* formed at the other end thereof. The first terminal pivot portion 522*a* and the second terminal pivot portion 522*b* are respectively located on the both sides of a longitudinal center line of the base 10*b*. The first movable contact 54*a* and the second movable contact 54*b* are movably contacted with the pair of first pathway terminals 31 or the pair of second pathway terminals 32.

Specifically, the first movable terminal 5*a* of the movable terminal module 50 includes a first body portion 51*a*, a first protruding portion 53*a*, a first extending portion 52*a* and a traverse portion 55*a*. The first body portion 51*a* is cladded by the insulating member 5*c*, and the first protruding portion 53*a* and the first extending portion 52*a* are respectively and integrally formed by the rearward and forward extension of the first body portion 51*a* and are exposed from the insulating member 5*c*. The first terminal pivot portion 522*a* is formed on the first protruding portion 53*a*, and the first movable contact 54*a* is formed on the first extending portion 52*a*. The traverse portion 55*a* extends from the first body portion 51*a* toward the second movable terminal 5*b*. In addition, the second movable terminal 5*b* of the movable terminal module 50 includes a second body portion 51*b*, a second protruding portion 53*b* and a second extending portion 52*b*. The second body portion 51*b* is cladded by the insulating member 5*c*, and the second protruding portion 53*b* and the second extending portion 52*b* are respectively and integrally formed by the rearward and forward direction of the second body portion 51*b* and exposed from the insulating member 5*c*. The second terminal pivot portion 522*b* is formed on the second protruding portion 53*b*, and the second movable contact 54*b* is formed on the second extending portion 52*b*.

In the present embodiment, the advantages of forming the structures of the first movable terminal 5*a* and the second movable terminal 5*b* by integrally stamping is that the manufacturing process can be simplified since the structures can be formed by integral stamping through just one stamping/bending procedure. In addition, the structures formed by integral stamping can maintain good precision, so as to avoid a cumulative tolerance from combining two parts, and therefore improve the accuracy. Furthermore, the first body portion 51*a* of the first movable terminal 5*a* and the second body portion 51*b* of the second movable terminal 5*b* can further include a plastic engaging hole to strengthen the combining force between the insulating member 5*c* and the first and second body portions 51*a*, 51*b*, so as to enhance the structural strength.

In addition, referring to FIG. 5A, the traverse portion 55*a* of the first movable terminal 5*a* forms a hanging hole 555 for combination, and the hanging hole 555 is exposed from the insulating member 5*c*. The hanging hole 555 of the traverse portion 55*a* can be in water drop shape as shown in FIG. 5A to FIG. 5*c*, however, the present invention is not limited thereto. The hanging hole can also be in other shapes. The water drop-shaped hanging hole 555 includes an arcuate inner edge 556 and two oblique inner edges 557 that join together to surroundingly form the hanging hole 555. The advantage of the water drop-shaped hanging hole 555 is that the oblique inner edges 557 can better limit the lateral displacement of the elastic member 60, so that the movable terminal module 50 can be more stable during the movement.

Referring to FIG. 5A and FIG. 5C, the traverse portion 55*a* of the first movable terminal 5*a* further extends forward along a plane to form a front end portion 551 protruding from the insulating member 5*c*. In the present embodiment, the second body portion 51*b* forms a recessed portion 510, and the traverse portion 55*a* of the first movable terminal 5*a* partially extends into the recessed portion 510, so as to strengthen the combining strength between the first movable terminal 5*a* and the insulating member 5*c*, and the combining strength between the second movable terminal 5*b* and the insulating member 5*c*.

The traverse portion 55*a* includes an oblique section 552 and a rearward section 553. The oblique section 552 slants toward a longitudinal direction of the second body portion 51*b*, and the rearward section 553 is connected with the oblique section 552 and is parallel to the longitudinal direction of the second body portions 51*b*. A forward portion 513 is formed on the first body portion 51*a*, and the forward portion 513 is parallel to a longitudinal direction of the first body portion 51*a* and corresponds to the rearward section 553, so as to form a T-shaped groove to combine with the insulating member 5*c*.

Figure 9:
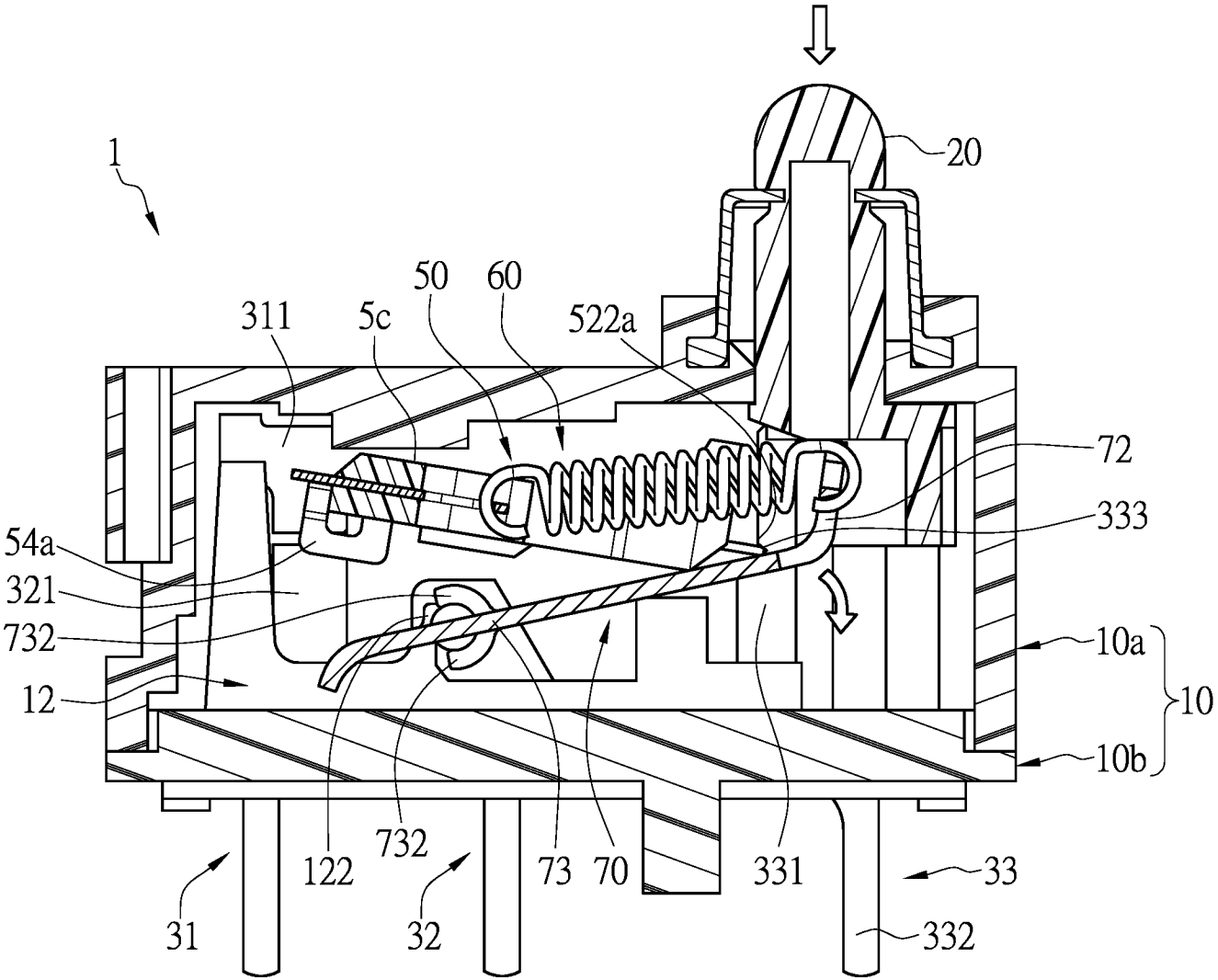
FIG. 9 is a sectional view of the conducting switch in the first conducting state.

Referring to FIG. 2 and FIG. 3, the fulcrum bar 70 includes a force receiving portion 72 and a pair of base connecting portions 73. Referring to FIG. 9, the force receiving portion 72 can abut against the bottom end of the operating stem 20. Specifically, the fulcrum bar 70 has an elongated body 71, and one end of the elongate body 71 forms the force receiving portion 72. The pair of base connecting portions 73 extends from the middle of the elongated body 71 to form an L-shaped extension at both sides, and a front end of the base connecting portion 73 is rotatably coupled to the base connecting portion 122 on the base 10*b*. In the present embodiment, the fulcrum bar 70 can be made of a rigid material such as a metal plate, but the present invention is not limited thereto.

In the present embodiment, the front end of the base connecting portion 73 of the fulcrum bar 70 is bifurcated to be a pair of arcuate claw portions 732. The pair of arcuate claw portions 732 can be formed by dividing and bending the front end of the base connecting portion 73.

The fulcrum bar connecting portion 122 of the base is in a round rod shape, the pair of arcuate claw portions 732 clamps the round rod-shaped fulcrum bar connecting portion 122, so that the base connecting portion 73 can rotate along the fulcrum bar connecting portion 122.

The lengths of the pair of arcuate claw portions 732 exceed a semi-cylindrical surface of the round rod-shaped base connecting portion 122, so that the connections are very stable. However, the present disclosure is not limited thereto.

The elastic member 60 can be a spring or other elastic member or the like, and the elastic member 60 is a tension spring in the present embodiment. One end of the elastic member 60 is connected with a portion of the fulcrum bar 70, and the other end of the elastic member 60 is connected with a portion of the movable terminal module 50. More specifically, one end of the elastic member 60 is connected with the hanging hole 555 of the movable terminal module 50.

Figure 6:
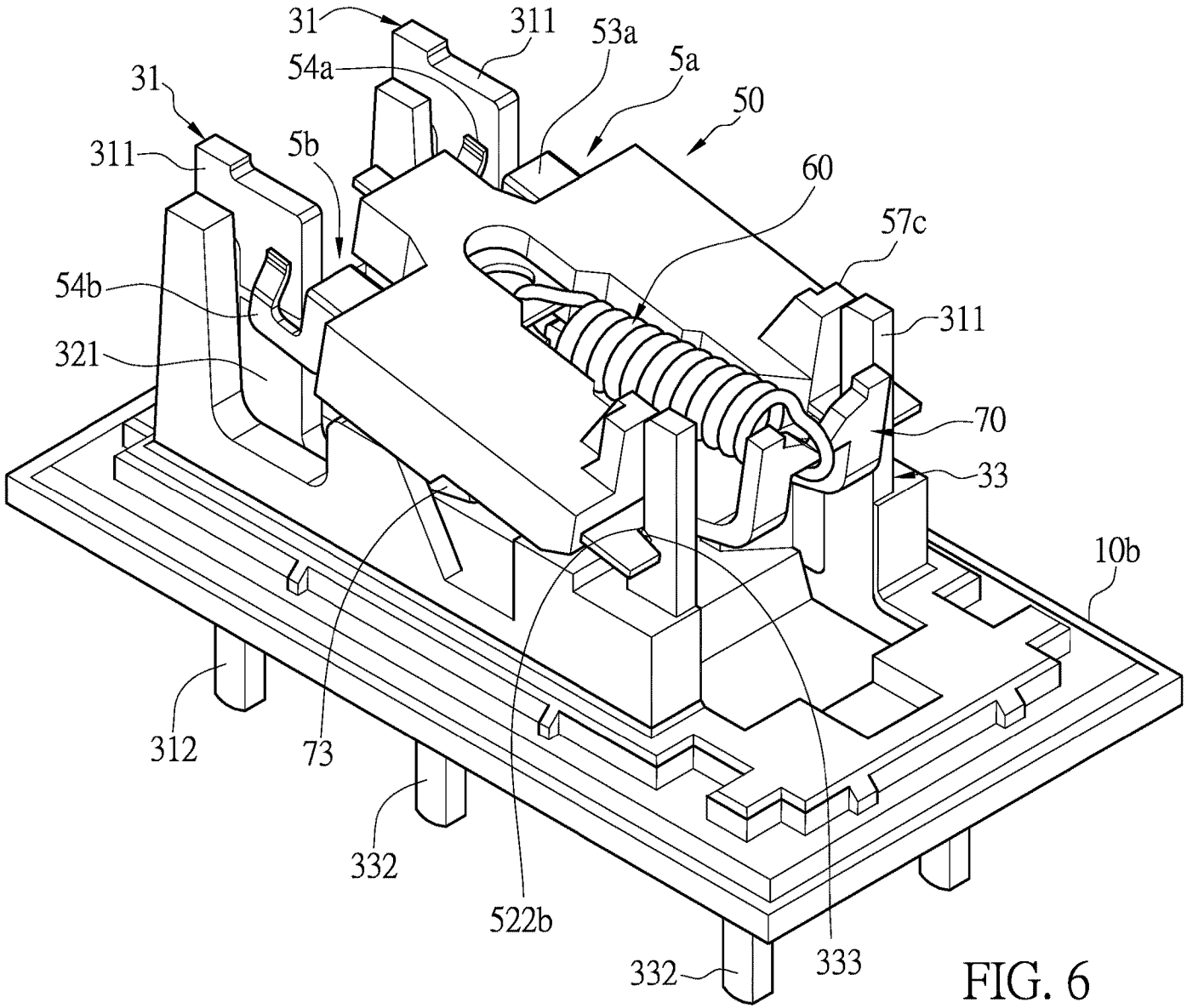
FIG. 6 is a perspective view of the conducting switch mechanism (omitting a cover and an operating stem) in a first conducting state.
Figure 7:
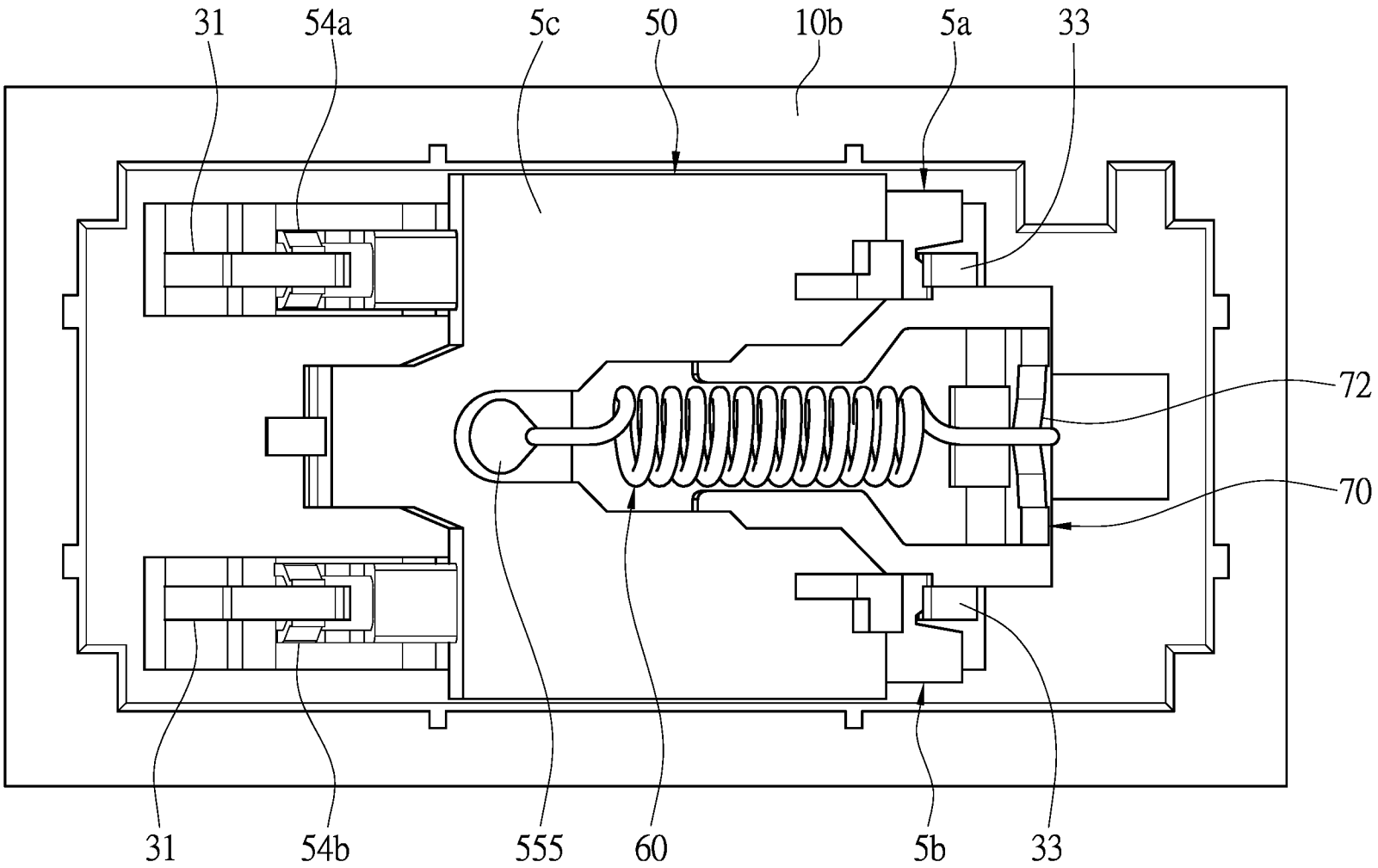
FIG. 7 is a top view of the conducting switch mechanism (omitting the cover and the operating stem) in the first conducting state.
Figure 8:
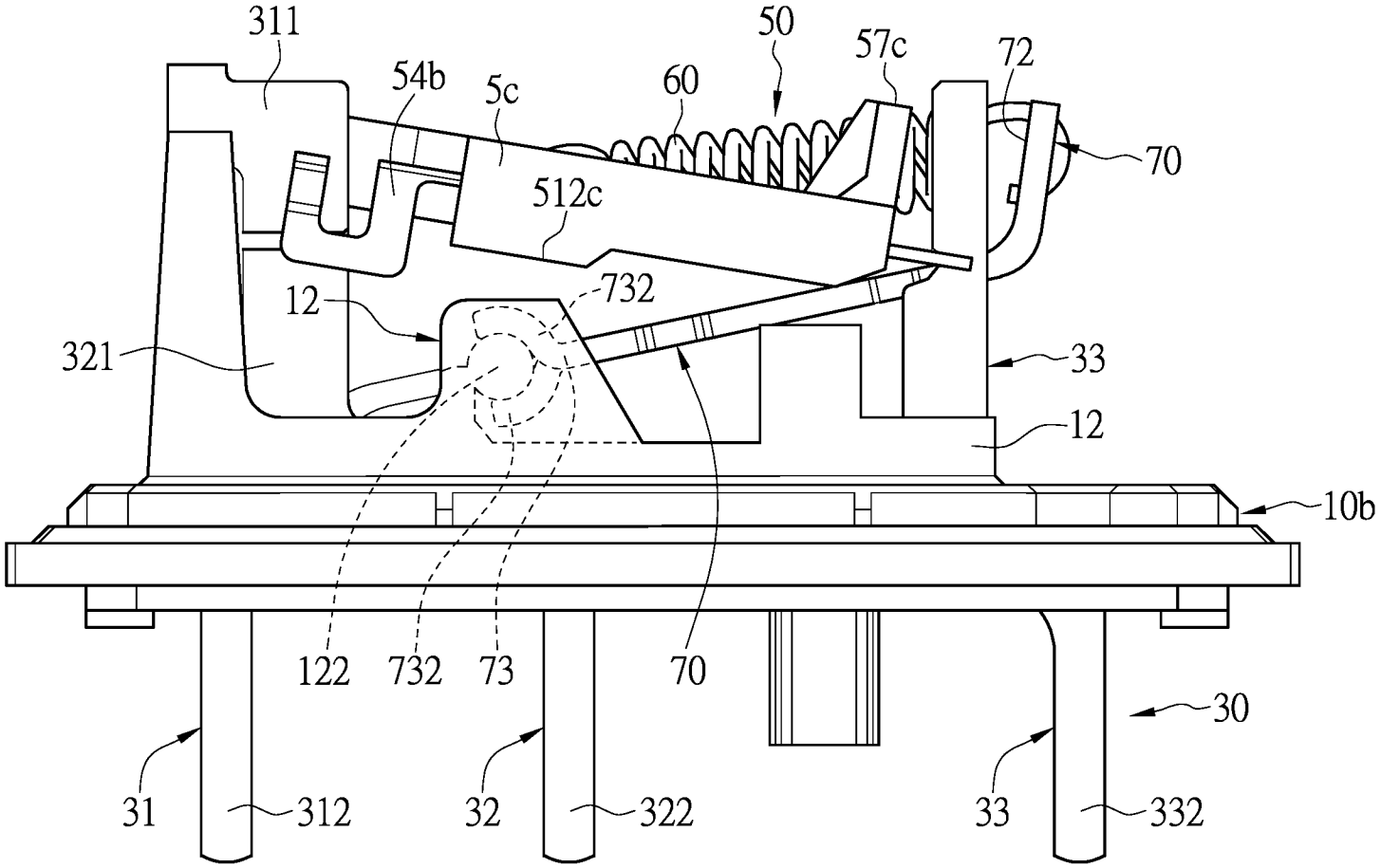
FIG. 8 is a side view of the conducting switch mechanism (omitting the cover and the operating stem) in the first conducting state.

Referring to FIG. 6 to FIG. 8, FIG. 6 to FIG. 8 are respectively a perspective view, a top view and a side view of the conducting switch mechanism 1 (omitting a cover and an operating stem) in a first conducting state. The assembling process of the conducting switch mechanism 1 of the present disclosure will be briefly described below. First, the two ends of the elastic member 60 are respectively connected to the fulcrum bar 70 and the movable terminal module 50. Further, a rear end of the movable terminal module 50, the first terminal pivot portion 522*a* of the first movable terminal 5*a* and the second terminal pivot portion 522*b* of the second movable terminal 5*b* are engagingly connected with the pivot receiving portion 333 of the constant contact terminal 33. Furthermore, the rear end of the movable terminal module 50, the first movable contact 54*a* and the second movable contact 54*b*, is slid downward to clamp the first pathway terminal 31. Subsequently, a rear end of the fulcrum bar 70, the force receiving portion 72 of the fulcrum bar 70, is pulled slightly rearward so that the pair of arcuate claw portions 732 of the base connecting portion 73 can clamp the round rod-shaped fulcrum bar connecting portion 122 of the holder 12.

The operating mechanism of the conducting switch mechanism 1 of the present disclosure will be briefly described below. When the operating stem 20 is pressed by an external force, the bottom of the operating stem 20 presses one end of the fulcrum bar 70 to drive the movable terminal module 50, and at the same time, the elastic member 60 is stretched to accumulate an elastic force. A slidable end of the movable terminal module 50 slidingly contacts a conductive portion of the fixed terminal group 30 to form one conductive state. When the external force disappears, the operating stem 20 and the fulcrum bar 70 are pulled by the elastic force of the elastic member 60 to return to the configuration before the external force is applied, and at the same time, the movable terminal module 50 is driven. The slidable end of the movable terminal module 50 slidably contacts another conductive portion of the fixed terminal group 30 to form another conductive state.

Referring to FIG. 6 and FIG. 8, in the first conducting state of the conducting switch mechanism 1 of the present disclosure, The first movable contact 54*a* of the first movable terminal 5*a* and the second movable contact 54*b* of the second movable terminal 5*b* are located at a higher position, that is, the first movable contact 54*a* and the second movable contact 54*b* respectively contact the first sliding portion 311 of the first pathway terminal 3 land the second sliding portion 321 of the second pathway terminal 32.

In addition, in the present embodiment, a pair of stoppers 57*c* protruded upwardly from a rear end of an insulating body portion 51*c* of the insulating member 5*c* of the movable terminal module 50 is adjacent to the first terminal pivot portion 522*a* and the second terminal pivot portion 522*b*, respectively. A position of the stopper 57*c* corresponds to a position of the constant contact terminal 33. In the first conducting state as shown in FIG. 6 and FIG. 8, the stopper 57*c* can abut against the constant contact terminal 33, so that the angle at which the movable terminal module 50 is reversed backward (the clockwise direction according to FIG. 8) can be restricted, so as to avoid the first movable contact 54*a* and the second movable contact 54*b* accidentally departing from the first pathway terminal 31.

In the embodiment, the configuration shown in FIG. 6 and FIG. 8 is the configuration of the conducting switch mechanism 1 while no external force applied, and is defined as the first conducting state. In the first conducting state, the operating stem 20 is not pressed by the external force. The fulcrum bar 70 is supported by the front end of the base connecting portion 73 (the pair of arcuate claw portions 732) as a pivot, and is subjected to a pulling force of the elastic member 60. The force receiving portion 72 of the fulcrum bar 70 is pulled up to approach the movable terminal module 50. The movable terminal module 50 is supported by the first terminal pivot portion 522*a* of the first movable terminal 5*a* and the second terminal pivot portion 522*b* of the second movable terminal 5*b* while pivoting, and is subjected to the pulling force of the elastic member 60, so that the first movable contact 54*a* and the second movable contact 54*b* (the second movable contact 54*b* is omitted in FIG. 9) are located at the higher position so as to contact the first sliding portion 311 of the first pathway terminal 31. In other words, the first conductive state is that the movable terminal module 50 electrically connects the constant contact terminal 33 to the first pathway terminal 31 to form a first pathway.

Figure 10:
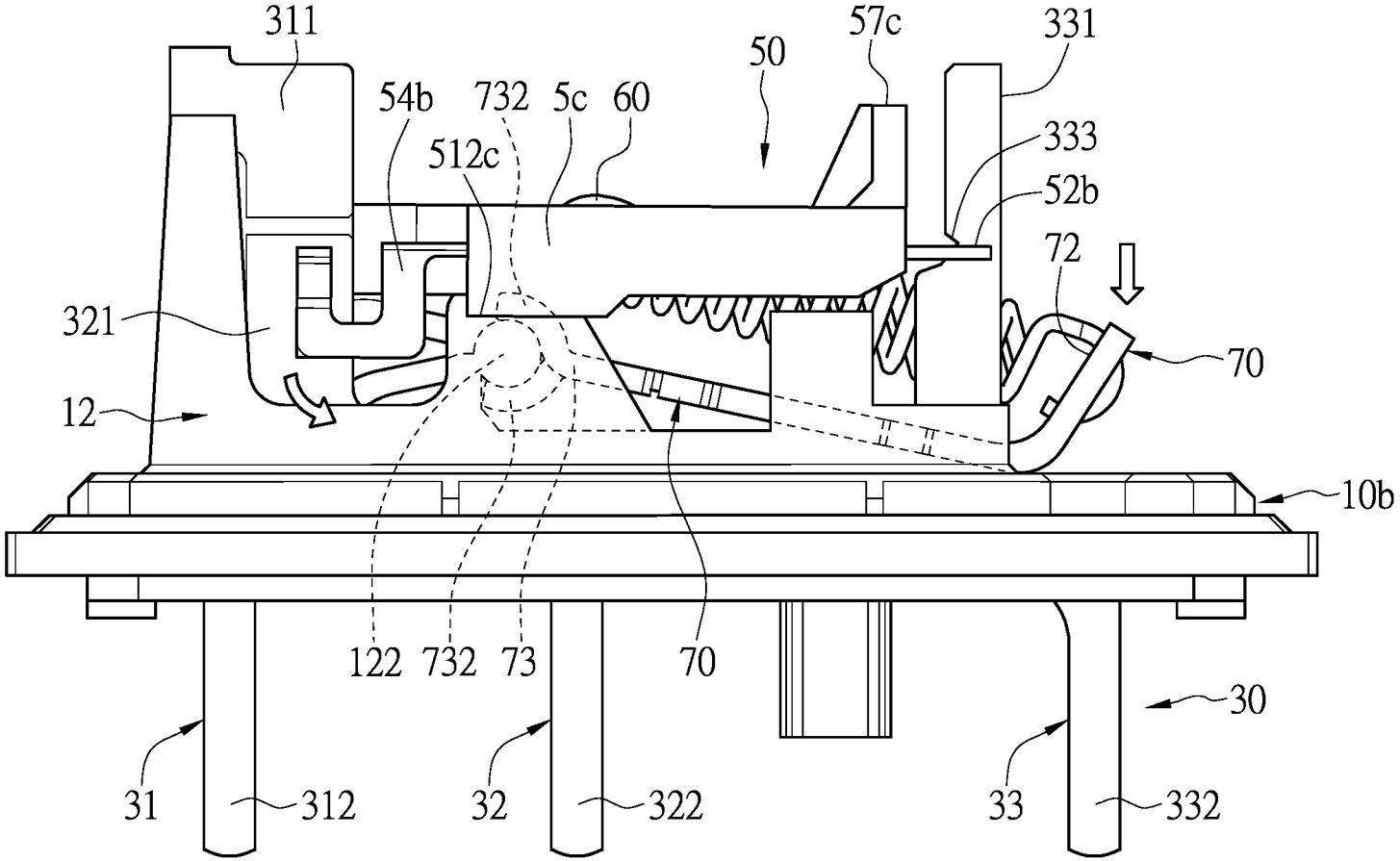
FIG. 10 is a sectional view of the conducting switch in a second conducting state.

Referring to FIG. 8 in conjunction with FIG. 2 and FIG. 3, two guiding protrusions 512*c* are disposed on the bottom of the insulating member 5*c* of the movable terminal module 50. Each one of the guiding protrusions 512*c* is substantially in a triangular columnar shape, so that when the movable terminal module 50 moves downward, the guiding protrusion 512*c* can guide the movable terminal module 50 to position the insulating member 5*c* on the holder 12 of the base 10*b*, that is, on the outermost two side walls of the holder 12 as shown in FIG. 10. In the present embodiment, the pair of arcuate claw portions 732 is clamped to the round rod-shaped fulcrum bar connecting portion 122, so that the base connecting portion 72 can rotate along the fulcrum bar connecting portion. The arcuate claw portion 732 abuts against the bottom end of the fulcrum bar connecting portion 122, and can also contribute to positioning the arcuate claw portion 732.

As shown in FIG. 9, the external force is applied on the operating stem 20 so as to turn to the configuration shown in FIG. 10, and such configuration is defined as a second conducting state. The force receiving portion 72 at the rear end of the fulcrum bar 70 is pressed by the operating stem 20, so that the fulcrum bar 70 rotates along the clockwise direction according to FIG. 9 and drives the movable terminal module 50. The movable terminal module 50 is supported by the first terminal pivot portion 522*a* and the second terminal pivot portion 522*b* while pivoting, and rotates along the counterclockwise direction according to FIG. 9.

The first movable contact 54*a* and the second movable contact 54*b* of the movable terminal module 50 move downward to contact the second sliding portion 321 of the second access terminal 32, so as to form the second conductive state. In the process, the elastic member 60 is stretched to accumulate the elastic force. In other words, the second conductive state is that the movable terminal module 50 electrically connects the constant contact terminal 33 to the second pathway terminal 32 to form the second pathway.

When the external force disappears, the configuration of the conducting switch mechanism 1 of the present disclosure is changed from the configuration of FIG. 10 to the configuration of FIG. 9. The operating stem 20 and the fulcrum bar 70 are pulled by the elastic force of the elastic member 60 to return to the configuration before the external force is applied. In other words, the force receiving portion 72 of the fulcrum bar 70 is turned upward, that is, moved counterclockwise. As shown in FIG. 9, the elastic member 60 also drives the movable terminal module 50. The movable terminal module 50 is moved upward (clockwise) with the first terminal fulcrum portion 522*a* and the second terminal fulcrum portion 522*b* while pivoting, and the first movable contact 54*a* and the second movable contact 54*b* at the front end of the movable terminal module 50 slidingly contact the first sliding portion 311 of the first pathway terminal 31, so as to return to the first conductive state.

In conclusion, the features and effects of the conducting switch mechanism of the present disclosure are at least that the structures of the first movable terminal 5*a* and the second movable terminal 5*b* of the movable terminal module 50 are integrally stamped. The terminal pivot portions, the movable contacts and the body portion are all extended along the same plane, so that they are not required to be separately stamped and then welded.

In the present embodiment, the first movable terminal 5*a* and the second movable terminal 5*b* are preferably made of a copper alloy or other high strength conductive material with good elasticity. The terminal pivot portion, the movable contact portion and the body portion are all extended along the same plane. The movable contact can maintain a normal electrical connection with the fixed terminal group, and at the same time, the terminal pivot portion can abut against the pivot receiving portion 333 to maintain sufficient elasticity. In the present embodiment, the integrally stamped structures of the two movable terminals can maintain good precision so as to avoid a cumulative tolerance from recombining two individual parts of the movable terminals, and additionally, the structural strength can also be enhanced.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A conducting switch mechanism, comprising:

a housing including a cover and a base, wherein an accommodating space is formed in the housing, a pair of holders is disposed on a top surface of the base, and two fulcrum bar connecting portions are correspondingly formed on each of the inner sides of each of the holders;

an operating stem, wherein a top end of the operating stem is exposed from the cover, and a bottom end of the operating stem extends into the accommodating space;

a fixed terminal set fixed on the base, wherein the fixed terminal set includes a pair of constant contact terminals, a pair of first pathway terminals, and a pair of second pathway terminals;

a movable terminal module including a first movable terminal, a second movable terminal and an insulating member, wherein the insulating member partially clads the first movable terminal and the second movable terminal, both structures of the first movable terminal and the second movable terminal are formed by integral stamping, a first movable contact is formed on one end of the first movable terminal, a first terminal pivot portion is formed on another end of the first movable terminal, a second movable contact is formed on one end of the second movable terminal, a second terminal pivot portion is formed on another end of the second movable terminal, the first terminal pivot portion and the second terminal pivot portion are movably contacted with the constant contact terminals, and the first movable contact and the second movable contact are movably contacted with the pair of first pathway terminals or the pair of second pathway terminals;

a fulcrum bar including a force receiving portion and a base connecting portion, wherein the force receiving portion can abut against the bottom end of the operating stem, and a front end of the base connecting portion is rotatably coupled with the fulcrum bar connecting portion of the base; and an elastic member having one end connecting with a portion of the fulcrum bar and another end connecting with a portion of the movable terminal module;

wherein the first movable terminal of the movable terminal module includes a first body portion, a first protruding portion, a first extending portion and a traverse portion, the first protruding portion and the first extending portion are respectively and integrally formed by the rearward and forward extension of the first body portion and exposed from the insulating member, the first protruding portion forms the first terminal pivot portion, the first extending portion forms the first movable contact, and the traverse portion extends from the first body portion toward the second movable terminal, and wherein the traverse portion of the first movable terminal forms a hanging hole for combination, the hanging hole is exposed from the insulating member, and one end of the elastic member is connected with the hanging hole;

wherein the hanging hole of the traverse portion is in a water drop shape, the water drop shape includes an arcuate inner edge and two oblique inner edges that join together to surroundingly form the hanging hole, and the two oblique inner edges limit the lateral displacement of the elastic member.

2. The conducting switch mechanism according to claim 1, wherein the front end of the base connecting portion of the fulcrum bar is bifurcated to be a pair of arcuate claw portion, the fulcrum bar connecting portion of the base is in a round rod shape, the pair of arcuate claw portion clamps the fulcrum bar connecting portion, so that the base connecting portion can rotate along the fulcrum bar connecting portion.

3. The conducting switch mechanism according to claim 1, wherein the traverse portion of the first movable terminal further extends forward along a plane to form a front end portion protruding from the insulating member.

4. The conducting switch mechanism according to claim 1, wherein the second movable terminal of the movable terminal module includes a second body portion, a second protruding portion and a second extending portion, the second protruding portion and the second extending portion are respectively and integrally formed by the rearward and forward extension of the second body portion and exposed from the insulating member, the second protruding portion forms the second terminal pivot portion, and the second extending portion forms the second movable contact; wherein the second body portion forms a recessed portion, and the traverse portion of the first movable terminal extends into the recessed portion.

5. The conducting switch mechanism according to claim 4, wherein the traverse portion includes an oblique section and a rearward section, the oblique section slants toward a longitudinal direction of the second body portion, the rearward section is connected with the oblique section and is parallel to the longitudinal direction of the second body portion, a forward portion is formed on the first body portion, the forward portion is parallel to a longitudinal direction of the first body portion and corresponds to the rearward section, so as to form a T-shaped groove to combine with the insulating member.

6. The conducting switch mechanism according to claim 1, wherein the pair of first pathway terminals are adjacent to the pair of second pathway terminals, the first pathway terminal includes a first sliding portion and a first pin, the second pathway terminal includes a second sliding portion and a second pin, the first sliding portion is adjacent to the second sliding portion and is arranged along a longitudinal direction parallel to the operating stem, the second pin extends from the second sliding portion away from the first pathway terminal, so as to be located between the first pathway terminal and the constant contact terminal, the constant contact terminal includes a constant contact portion and a constant pin, the constant contact portion corresponds to the first sliding portion and the second sliding portion, and the second pin is located between the first pin and the constant pin.

7. The conducting switch mechanism according to claim 6, wherein the constant contact portion forms a pivot receiving portion, and the first terminal pivot portion of the first movable terminal and the second terminal pivot portion of the second movable terminal are engagingly connected to the pivot receiving portion.

8. The conducting switch mechanism according to claim 1, wherein a bottom edge of the cover of the housing forms a chute, a combination layer is disposed on the base, a welding bevel is formed on a peripheral edge of the combination layer, the area of the combination layer is smaller than the area of the top surface of the base, and the chute has a position and a shape corresponding to those of the welding bevel, such that the chute and the welding bevel can be welded to each other.

9. A conducting switch mechanism, comprising:

a housing including a cover and a base, wherein an accommodating space is formed in the housing, a pair of holders is disposed on a top surface of the base, and two fulcrum bar connecting portions are correspondingly formed on each of the inner sides of each of the holders;

an operating stem, wherein a top end of the operating stem is exposed from the cover, and a bottom end of the operating stem extends into the accommodating space;

a fixed terminal set fixed on the base, wherein the fixed terminal set includes a pair of constant contact terminals, a pair of first pathway terminals, and a pair of second pathway terminals;

a movable terminal module including a first movable terminal, a second movable terminal and an insulating member, wherein the insulating member partially dads the first movable terminal and the second movable terminal, both structures of the first movable terminal and the second movable terminal are formed by integral stamping, a first movable contact is formed on one end of the first movable terminal, a first terminal pivot portion is formed on another end of the first movable terminal, a second movable contact is formed on one end of the second movable terminal, a second terminal pivot portion is formed on another end of the second movable terminal, the first terminal pivot portion and the second terminal pivot portion are movably contacted with the constant contact terminals, and the first movable contact and the second movable contact are movably contacted with the pair of first pathway terminals or the pair of second pathway terminals;

a fulcrum bar including a force receiving portion and a base connecting portion, wherein the force receiving portion can abut against the bottom end of the operating stem, and a front end of the base connecting portion is rotatably coupled with the fulcrum bar connecting portion of the base; and an elastic member having one end connecting with a portion of the fulcrum bar and another end connecting with a portion of the movable terminal module;

wherein the first movable terminal of the movable terminal module includes a first body portion, a first protruding portion, a first extending portion and a traverse portion, the first protruding portion and the first extending portion are respectively and integrally formed by the rearward and forward extension of the first body portion and exposed from the insulating member, the first protruding portion forms the first terminal pivot portion, the first extending portion forms the first movable contact, and the traverse portion extends from the first body portion toward the second movable terminal, and wherein the traverse portion of the first movable terminal forms a hanging hole for combination, the hanging hole is exposed from the insulating member, and one end of the elastic member is connected with the hanging hole;

wherein the second movable terminal of the movable terminal module includes a second body portion, a second protruding portion and a second extending portion, the second protruding portion and the second extending portion are respectively and integrally formed by the rearward and forward extension of the second body portion and exposed from the insulating member, the second protruding portion forms the second terminal pivot portion, and the second extending portion forms the second movable contact; wherein the second body portion forms a recessed portion, and the traverse portion of the first movable terminal extends into the recessed portion;

wherein the traverse portion includes an oblique section and a rearward section, the oblique section slants toward a longitudinal direction of the second body portion, the rearward section is connected with the oblique section and is parallel to the longitudinal direction of the second body portion, a forward portion is formed on the first body portion, the forward portion is parallel to a longitudinal direction of the first body portion and corresponds to the rearward section, so as to form a T-shaped groove to combine with the insulating member.

* * * * *